US006378726B1

(12) United States Patent
Chan et al.

(10) Patent No.: US 6,378,726 B1
(45) Date of Patent: Apr. 30, 2002

(54) INTERFOLDED NAPKIN DISPENSING SYSTEM

(75) Inventors: Michael Yuwah Chan; Paul Francis Tramontina, both of Alpharetta, GA (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 556 days.

(21) Appl. No.: 08/755,435

(22) Filed: Nov. 22, 1996

(51) Int. Cl.[7] ..... B65H 1/00

(52) U.S. Cl. ..... 221/51; 221/52; 221/53; 221/63

(58) Field of Search ..... 221/48, 51, 52, 221/53, 55, 56, 63; 206/494

(56) References Cited

U.S. PATENT DOCUMENTS

| | | | | | |
|---|---|---|---|---|---|
| 548,260 | A | | 10/1895 | Lucas | |
| 1,122,108 | A | | 12/1914 | Hamilton | |
| 1,151,064 | A | | 8/1915 | Swift | |
| 1,158,550 | A | | 11/1915 | Parsons | |
| 1,177,466 | A | | 3/1916 | Winter | |
| 1,511,812 | A | | 10/1924 | Horwitt | |
| 1,582,645 | A | | 4/1926 | Findley | |
| 1,632,446 | A | * | 6/1927 | Krueger | 221/53 |
| 1,681,639 | A | | 8/1928 | Hansen | |
| 1,683,641 | A | | 9/1928 | Whitney | |
| 1,697,654 | A | | 1/1929 | Jantzen | |
| 1,706,166 | A | | 3/1929 | Hunt | |
| 1,723,734 | A | | 8/1929 | Jordan | |
| 1,914,666 | A | * | 6/1933 | Hope et al. | 221/53 |
| 1,993,885 | A | | 3/1935 | Horwitt | 312/61 |
| 2,002,691 | A | | 5/1935 | Cofrin | 206/57 |
| 2,143,614 | A | * | 1/1939 | Winter et al. | 221/53 |
| 2,195,622 | A | | 4/1940 | Fourness et al. | 206/57 |
| 2,244,630 | A | | 6/1941 | Metternich | 206/57 |
| 2,253,742 | A | * | 8/1941 | West et al. | 221/52 |
| 2,382,368 | A | | 8/1945 | Mitchell | 206/56 |
| 2,433,587 | A | | 12/1947 | Wentworth | 312/50 |
| 2,477,223 | A | | 7/1949 | West | 206/57 |
| 2,689,059 | A | * | 9/1954 | Nadell | 221/63 |
| 2,765,909 | A | | 10/1956 | Graham | 206/57 |
| 2,858,044 | A | | 10/1958 | Schadenburg | 221/46 |
| 2,933,431 | A | | 4/1960 | Sperouleas | 167/84 |
| 2,953,293 | A | | 9/1960 | Anderson | 229/51 |
| 3,119,516 | A | | 1/1964 | Donovan | 221/47 |
| 3,203,586 | A | * | 8/1965 | Downham | 221/55 |
| 3,249,255 | A | | 5/1966 | Cohen | 221/63 |
| 3,425,595 | A | * | 2/1969 | Shapira | 221/52 |
| 3,589,555 | A | | 6/1971 | Burkhalter | 221/35 |
| 3,624,791 | A | | 11/1971 | Taub | 221/59 |
| 3,684,086 | A | | 8/1972 | Harrison | 206/46 |
| 3,754,681 | A | | 8/1973 | Slye et al. | 221/45 |
| 3,982,685 | A | | 9/1976 | Shimada | 229/51 |
| 4,143,762 | A | | 3/1979 | Spiegelberg | 206/210 |

(List continued on next page.)

FOREIGN PATENT DOCUMENTS

| | | |
|---|---|---|
| CH | 178495 | 7/1935 |
| FR | 336986 | 11/1903 |
| FR | 2115834 A | 7/1972 |

*Primary Examiner*—H. Grant Skaggs
(74) *Attorney, Agent, or Firm*—Karl V. Sidor

(57) ABSTRACT

An interfolded paper napkin dispensing system composed of: (a) an outer housing defining an interior space; (b) stacking means mounted within the outer housing for holding a stack of paper napkins within the interior space; and (c) a dispensing face defined in the outer housing proximate to an end of the stacking means. The dispensing face has a central portion projecting out from the dispenser and a dispensing throat located in the central portion. The dispensing throat is composed of a slot portion having a length sufficient to permit a paper napkin to be pulled through by a user, but a relatively narrow width that prevents more than a few napkins from being pulled through the throat at one time. The dispensing throat further includes a finger access portion to help a user grip and pull a paper napkin through the dispensing slot despite the relatively narrow width of the dispensing slot.

2 Claims, 3 Drawing Sheets

U.S. PATENT DOCUMENTS

| | | | | |
|---|---|---|---|---|
| 4,181,225 | A | 1/1980 | Spiegelberg | 206/494 |
| 4,191,307 | A | 3/1980 | LeCaire et al. | 221/45 |
| 4,289,262 | A | 9/1981 | Finkelstein | 225/106 |
| 4,411,374 | A | 10/1983 | Hotchkiss | 211/63 |
| 4,453,649 | A | 6/1984 | Origuchi | 221/26 |
| 4,679,703 | A | 7/1987 | De Luca | 221/52 |
| 4,781,306 | A | 11/1988 | Smith | 221/33 |
| 4,848,575 | A | 7/1989 | Nakamura et al. | 206/449 |
| 4,896,773 | A | 1/1990 | Zilio | 206/494 |
| 4,953,746 | A | 9/1990 | Andriash | 221/35 |
| 4,953,747 | A | 9/1990 | Wenkman et al. | 221/45 |
| 4,969,575 | A | 11/1990 | Kobayashi | 221/45 |
| 5,074,430 | A | 12/1991 | Roberts | 221/44 |
| 5,076,466 | A | 12/1991 | Petterson et al. | 221/46 |
| 5,090,592 | A | 2/1992 | Petterson et al. | 221/55 |
| 5,100,020 | A | 3/1992 | Petterson et al. | 221/45 |
| 5,102,007 | A | 4/1992 | Petterson et al. | 221/6 |
| 5,137,173 | A | 8/1992 | Hughes et al. | 221/34 |
| 5,165,570 | A | 11/1992 | Windorski et al. | 221/46 |
| 5,199,601 | A | 4/1993 | Roethal | 221/310 |
| 5,219,092 | A | 6/1993 | Morand | 221/53 |
| 5,332,118 | A | 7/1994 | Muckenfuhs et al. | 221/48 |
| 5,368,188 | A | 11/1994 | Twardowski | 221/50 |
| 5,497,903 | A | 3/1996 | Yoneyama | 221/48 |
| 5,516,001 | A | 5/1996 | Muckenfuhs et al. | 221/63 |
| 5,520,308 | A | 5/1996 | Berg et al. | 221/50 |
| 5,524,759 | A | 6/1996 | Herzberg et al. | 206/494 |
| 5,531,325 | A | 7/1996 | Deflander et al. | 206/494 |
| 5,540,332 | A | 7/1996 | Kopacz et al. | 206/494 |
| 5,565,258 | A | 10/1996 | McConnell et al. | 428/122 |
| 5,607,754 | A | 3/1997 | Giles et al. | 428/211 |
| 5,613,608 | A | 3/1997 | Tronchetti et al. | 206/494 |
| 5,630,511 | A | 5/1997 | Bose | 206/555 |
| 6,003,723 | A * | 12/1999 | Morand | 221/53 |
| 6,286,713 | B1 * | 9/2001 | Chan et al. | 221/63 |

* cited by examiner

INTERFOLDED NAPKIN DISPENSING SYSTEM

FIELD OF THE INVENTION

This invention generally relates the field of dispensing devices and systems. More particularly, this invention relates to the field of devices and systems for dispensing folded sheets of material.

BACKGROUND

Dispensers for paper napkins are often provided at quick service food locations. One disadvantage of many conventional paper napkin dispensers is that they often permit removal of large clumps of napkins at one time. Studies have shown most paper napkins removed in this manner are wasted. Many end up scattered about an eating area, tossed as litter or, even worse, being stuffed in plumbing fixtures. When clumps of napkins are taken, dispensers quickly run out and must be refilled inconveniencing both customers and operators of quick service food locations.

A long and unfilled need exists for a paper napkin dispensing system that will deter and resist wasteful dispensing.

SUMMARY OF THE INVENTION

The problems and needs described above are addressed by the present invention which provides an interfolded paper napkin dispensing system composed of: (a) an outer housing defining an interior space; (b) stacking means mounted within the outer housing for holding a stack of paper napkins within the interior space; and (c) a dispensing face defined in the outer housing proximate to an end of the stacking means.

The dispensing face has a central portion projecting out from the dispenser and a dispensing throat located in the central portion. The dispensing throat is composed of a slot portion having a length sufficient to permit a paper napkin to be pulled through by a user, but a relatively narrow width that prevents more than a few napkins from being pulled through the throat at one time. The dispensing throat further includes a finger access portion to help a user grip and pull a paper napkin through the dispensing slot despite the relatively narrow width of the dispensing slot.

According to the invention, the stacking means are composed of a staging area proximate the dispensing throat for spacing, bowing and slowing napkins as they approach the dispensing throat. The staging area may be composed of at least two curved bumpers oriented so as to be parallel to the path of travel of the napkins as they approach the dispensing throat, and a number of ribs defined on the bumpers for temporarily arresting movement of the napkins as they approach the dispensing throat. Desirably, the staging area and bumpers are configured to cause the napkins to bow out into the dispensing throat.

In an aspect of the invention, the slot portion of the dispensing throat may have a point of minimum width that is less than about 1.0 inch. For example, the slot portion of the dispensing throat may have a point of minimum width that is less than about 0.75 inches. As another example, the slot portion of the dispensing throat may have a point of minimum width that is less than about 0.5 inches.

According to the invention, the finger access portion of the dispensing throat may have a point of maximum width that is greater than about 0.75 inches. For example, the finger access portion of the dispensing throat may have a point of maximum width that is greater than about 1 inch. Desirably, the finger access portion of the dispensing throat is at the center of the dispensing throat and may have a length (i.e., a length along the dispensing throat) of about 1 inch or more. For example, the finger access portion of the dispensing throat may have a length from about 1 inch to about 3 inches or more. Typically, the finger access portion of the dispensing throat may have a length that is about one-half the length of the dispensing throat. Of coarse, it is contemplated that the finger access portion of the dispensing throat may have a length that is about one-quarter to about three-quarter the length of the dispensing throat.

According to the present invention, the central portion of the dispensing face may project out from the dispenser in the form of a first surface and a second surface joined at an obtuse angle. In such an embodiment, the dispensing throat should be located at about the intersection of the first and second surfaces. Other configurations of the dispensing face which provide a crease or break in the plane of the dispensing face at the dispensing throat may also be used.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying description of the invention.

DETAILED DESCRIPTION

Figure 1:
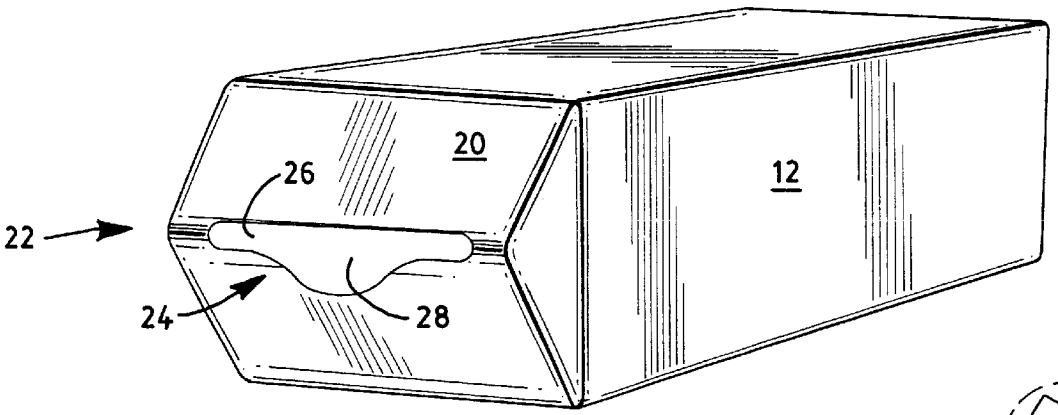
FIG. 1 is a perspective view illustration of an exemplary interfolded napkin dispensing system.
Figure 2:
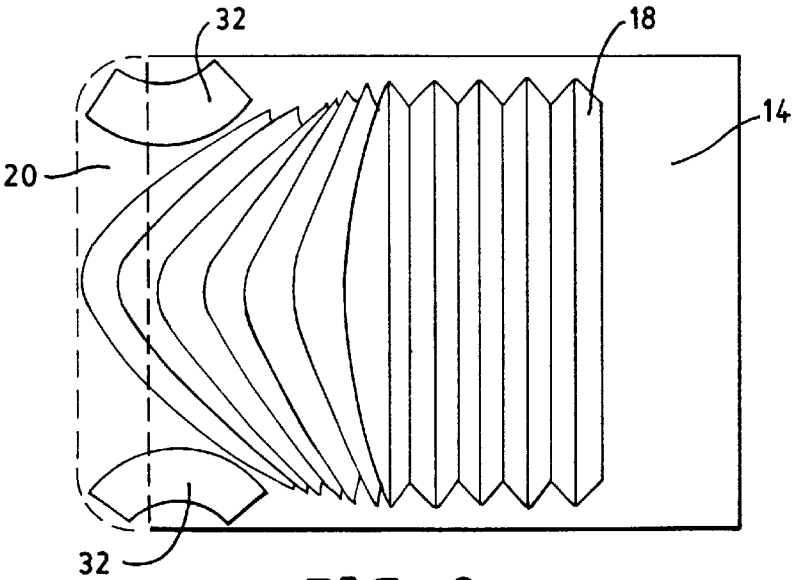
FIG. 2 is an illustration of a detail of an exemplary interfolded napkin dispensing system.

Referring now to the drawings, wherein like reference numerals designate corresponding structure throughout the views, and referring in particular to FIGS. 1 and 2, there is shown an exemplary interfolded paper napkin dispensing system. The system includes an outer housing 12 defining an interior space 14 that contains a stacking means 16 which is mounted within the outer housing 12 for holding a stack of paper napkins 18 within the interior space.

The system also includes a dispensing face 20 defined in the outer housing 12 proximate to an end of the stacking means 16.

The dispensing face 20 has a central portion 22 projecting out from the outer housing 12 and a dispensing throat 24 located in the central portion 22. The dispensing throat 24 is composed of a slot portion 26 having a length sufficient to permit a paper napkin to he pulled through by a user, but a relatively narrow width that prevents more than a few napkins from being pulled through the throat at one time.

The dispensing throat 24 further includes a finger access portion 28 to help a user grip and pull an interfolded paper napkin through the dispensing slot despite the relatively narrow width of the dispensing slot 26.

Figure 3:
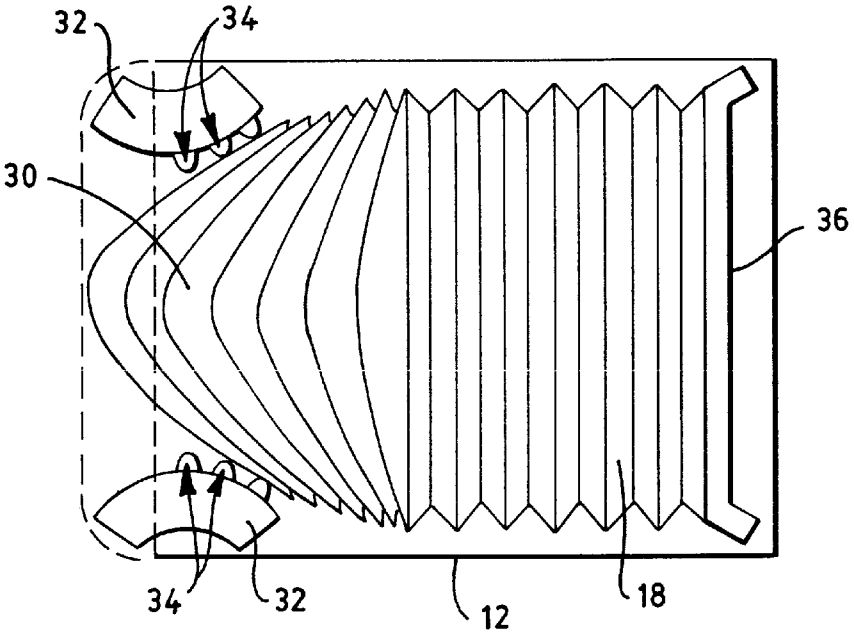
FIG. 3 is an illustration of a detail of an exemplary interfolded napkin dispensing system.

Referring now to FIG. 3, the stacking means 16 are composed of a staging area 30 proximate the dispensing throat 24 for spacing and slowing napkins as they approach the dispensing throat. The staging area 30 may be composed of at least two bumpers 32 oriented so as to be parallel to the path of travel of the napkins as they approach the dispensing throat, and a number of ribs 34 defined on the bumpers 32 for temporarily arresting movement of the napkins as they approach the dispensing throat.

The bumpers 32, in combination with a spring loaded plate 36 that pushes against the stack of napkins 18, cause the interfolded napkins to bow out or buckle into the dispensing throat 24. Such a configuration is believed to aid dispensing of the napkins by causing the napkins to feed into the dispensing throat 24 relatively uniformly and relatively independent of how full the dispenser is during dispensing. The bumpers also center the napkins on the dispensing throat to reduce the likelihood that napkins will drag against an end of the dispensing slot creating friction that may tear a napkin and interrupt dispensing. The bow or buckle in the napkins is thought to enhance the contact/friction between interfolded sheets of the paper napkin for more reliable dispensing.

Figure 4:
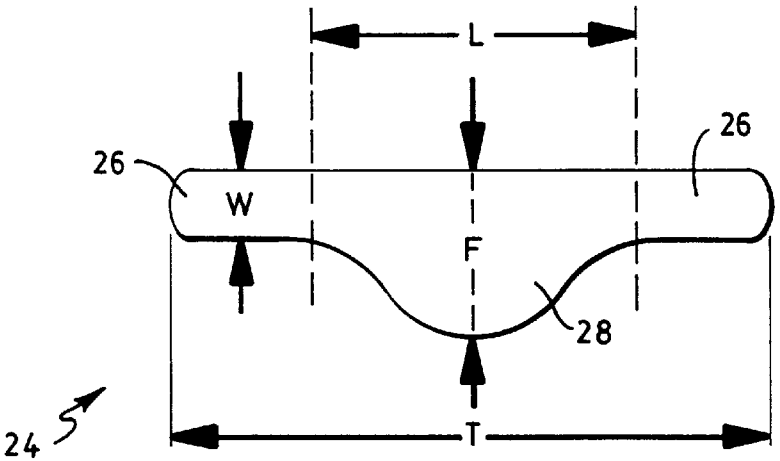
FIG. 4 is an illustration of a dispensing throat of an exemplary interfolded napkin dispensing system.

Referring now to FIG. 4, there is shown a detail of the dispensing throat 24 which reveals a configuration to prevent large clumps of paper napkins from being pulled out of the dispenser at one time. Specifically, the dispensing throat 24 has a slot portion 26 that has a length sufficient to permit a paper napkin to be pulled through by a user, but a relatively narrow width that will prevent more than a few paper napkins from being pulled through the throat at one time. The dispensing throat 24 includes a finger access portion 28 to help a user grip and pull a paper napkin through the dispensing slot 26 despite the relatively narrow width of the slot.

The slot portion 26 of the dispensing throat 24 may have a point of minimum width "W" that is less than about 1.0 inch. For example, the slot portion "W" of the dispensing throat may have a point of minimum width that is less than about 0.75 inches. As another example, the slot portion "W" of the dispensing throat may have a point of minimum width that is less than about 0.5 inches.

The finger access portion 28 of the dispensing throat may have a point of maximum width "F" that is greater than about 0.75 inches. For example, the finger access portion of the dispensing throat may have a point of maximum width "F" that is greater than about 1 inch.

Desirably, the finger access portion 28 of the dispensing throat 24 is at the center of the dispensing throat and may have a length "L" (i.e., a length along the dispensing throat) of about 1 inch or more. For example, the finger access portion of the dispensing throat may have a length "L" from about 1 inch to about 3 inches or more. Typically, the finger access portion of the dispensing throat may have a length "L" that is about one-half the total length "T" of the dispensing throat. Of coarse, it is contemplated that the finger access portion of the dispensing throat may have a length "L" that is about one-quarter to about three-quarter the total length "T" of the dispensing throat.

Figure 5:
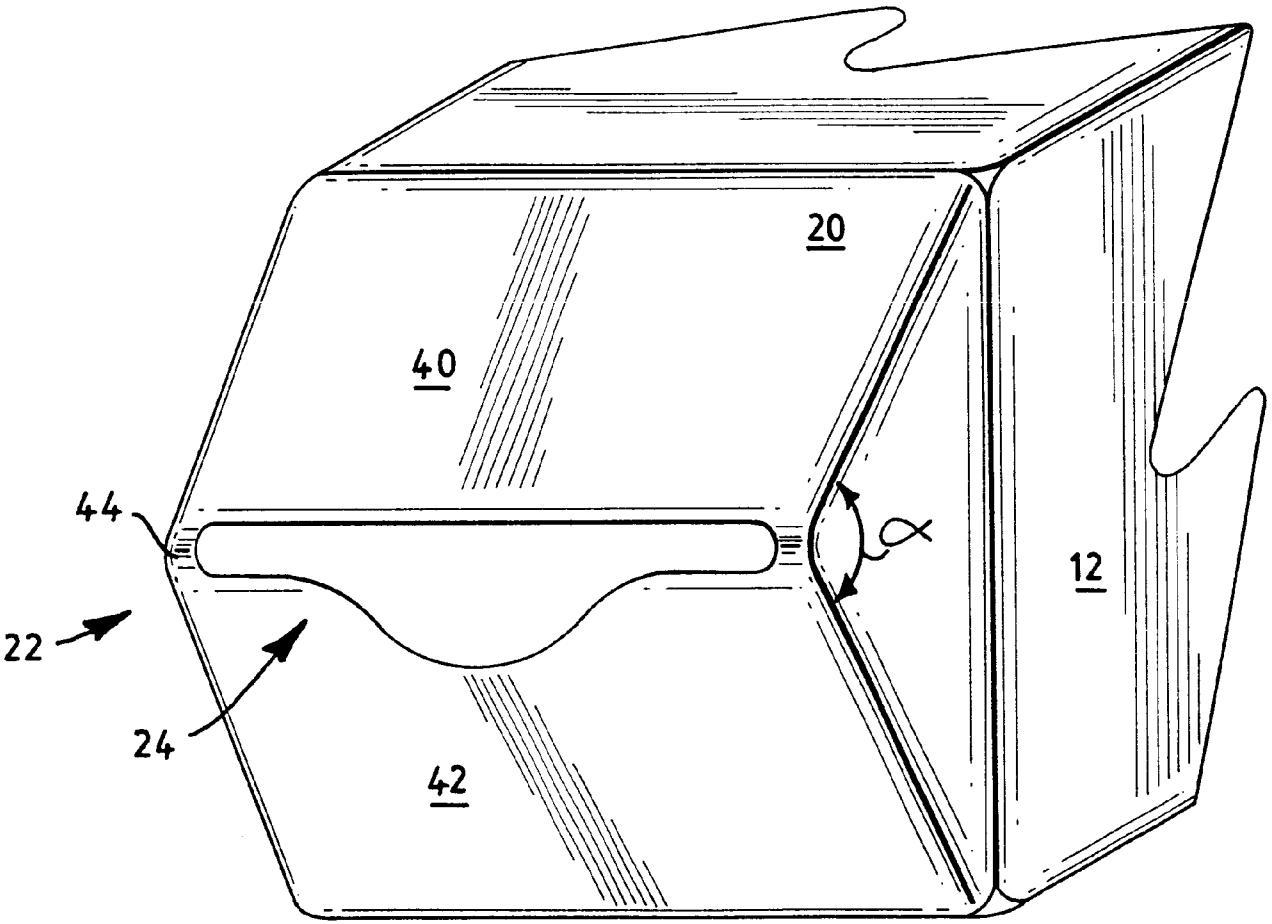
FIG. 5 is a perspective view illustration of a dispensing face from an exemplary interfolded napkin dispensing system.

Referring now to FIG. 5, it can be seen that the central portion 22 of the dispensing face 20 projects out from the outer housing 12 of the dispenser. In an embodiment of the invention, the central portion 22 of the dispensing face 20 projects out in the form of a first surface 40 and a second surface 42 joined at an obtuse angle $\alpha$ (i.e., greater than 90 and less than 180 degrees). The dispensing throat 24 should be located at about the intersection 44 of the first and second surfaces 40, 42 where there is a crease or break in the plane of the dispensing face 20. Such configuration is thought to provide better access to the paper napkins through the relatively narrow dispensing slot 26. It is contemplates that other configurations of the dispensing face which provide a suitable crease or break in the plane of the dispensing face at the dispensing throat may be used.

Generally speaking, the angle $\alpha$ may range from about 175 degrees to about 160 degrees to provide a crease or break in the plane of the dispensing face 20. For example, the angle $\alpha$ may range from about 173 degrees to about 162 degrees. As another example, the angle $\alpha$ may range from about 170 degrees to about 165 degrees.

During normal operation, a consumer will grasp the interfolded paper napkin by grabbing the portion or tail of the interfolded napkin protruding/extending through the dispensing slot. As the interfolded napkin is dispensed, another portion of the succeeding napkin is withdrawn to provide the next outwardly extending protruding portion/tail of the napkin. If the consumer encounters a new stack of interfolded napkins in which the tail does not protrude through the dispensing slot 26 or if the previous dispensing failed to properly draw a new tail through the slot, the user will grasp the exposed portion of the paper napkin and pinch the body of the napkin by placing one or more fingers in the finger access portion 28 of the dispensing throat 24. If the user pulls too aggressively, such as in an attempt to pull a large clump of paper napkins out of the dispenser, the attempt will be thwarted because a large clump of napkins will not fit through the dispensing slot 26. Accordingly, wasteful dispensing of the paper napkins is reduced.

The present invention had been found to be particularly desirable for use with horizontally placed interfolded paper napkin dispensers. The combination of a narrow dispensing throat, projecting dispensing face, stacking means and bumpers that bow out the napkins in a staging area provide reliable and less wasteful dispensing of interfolded paper napkins.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An interfolded paper napkin dispensing system comprising:

an outer housing defining an interior space;

stacking means mounted within the outer housing for holding a stack of interfolded paper napkins within the interior space, the stacking means comprising a staging area proximate a dispensing throat for spacing and slowing the interfolded napkins as they approach the dispensing throat, the staging area comprising at least two curved bumpers oriented so as to be parallel to the path of travel of the napkins as they approach the dispensing throat, and a number of ribs defined on the bumpers for temporarily arresting movement of the napkins as they approach the dispensing throat; and a dispensing face defined in the outer housing proximate to an end of the stacking means, the dispensing face having a central portion projecting out from the dispenser and a dispensing throat located in the central portion, the dispensing throat comprising a slot portion having a length sufficient to permit an interfolded paper napkin to be pulled through by a user, but a relatively narrow width that prevents more than a few interfolded napkins from being pulled though the throat at one time, the dispensing throat further comprising a finger access portion to help a user grip and pull an interfolded paper napkin through the dispensing slot despite the relatively narrow width of the dispensing slot.

2. An interfolded paper napkin dispensing system comprising:

an outer housing defining an interior space;

stacking means mounted within the outer housing for holding a stack of interfolded paper napkins within the interior space, the stacking means comprising a staging area proximate a dispensing throat for spacing and slowing the interfolded napkins as they approach the dispensing throat, the staging area comprising at least two curved bumpers oriented so as to be parallel to the path of travel of the napkins as they approach the dispensing throat, and a number of ribs defined on the bumpers for temporarily arresting movement of the napkins as they approach the dispensing throat, the staging area and bumpers configured to cause the napkins to bow out into the dispensing throat; and a dispensing face defined in the outer housing proximate to an end of the stacking means, the dispensing face having a central portion projecting out from the dispenser and a dispensing throat located in the central portion, the dispensing throat comprising a slot portion having a length sufficient to permit an interfolded paper napkin to be pulled through by a user, but a relatively narrow width that prevents more than a few interfolded napkins from being pulled though the throat at one time, the dispensing throat further comprising a finger access portion to help a user grip and pull an interfolded paper napkin through the dispensing slot despite the relatively narrow width of the dispensing slot.

* * * * *